United States Patent [19]

Davis

[11] Patent Number: 4,565,623

[45] Date of Patent: Jan. 21, 1986

[54] METHOD FOR DEASPHALTING HEAVY OILS USING A MISCIBLE SOLVENT AT A LOW TREAT RATIO AND A CARBON DIOXIDE ANTISOLVENT

[75] Inventor: Thomas A. Davis, Annandale, N.J.

[73] Assignee: Exxon Research and Engineering Co., Florham Park, N.J.

[21] Appl. No.: 642,502

[22] Filed: Aug. 20, 1984

[51] Int. Cl.[4] ..... C10C 3/08

[52] U.S. Cl. ..... 208/309; 208/351; 208/356; 208/362

[58] Field of Search ..... 208/309, 351, 356, 362

[56] References Cited

U.S. PATENT DOCUMENTS

| | | | |
|---|---|---|---|
| 2,141,361 | 12/1938 | Pilat et al. | 208/34 |
| 2,188,051 | 1/1940 | Lantz | 196/13 |
| 2,196,989 | 4/1940 | Henry et al. | 208/309 |
| 2,337,448 | 12/1943 | Carr | 196/13 |
| 2,631,966 | 3/1953 | Francis | 196/14.2 |
| 2,646,387 | 7/1953 | Francis et al. | 196/14.15 |
| 2,650,897 | 9/1953 | Woerner | 208/309 |
| 2,669,538 | 2/1954 | Yurasko et al. | 196/14.46 |
| 2,950,244 | 8/1960 | Lawson, Jr. | 208/309 |
| 3,202,605 | 8/1965 | Redcay | 208/309 |
| 3,334,043 | 9/1965 | Ferris et al. | 208/309 |
| 3,481,865 | 12/1969 | Samuels | 208/309 |
| 3,516,928 | 6/1970 | King et al. | 208/308 |
| 3,658,665 | 4/1972 | Crethen | 204/38 |
| 4,017,383 | 4/1977 | Beavon | 208/309 |
| 4,054,512 | 10/1977 | Dugan | 208/309 |
| 4,179,362 | 12/1979 | Irani et al. | 208/321 |
| 4,191,639 | 3/1980 | Audeh et al. | 208/309 |
| 4,201,660 | 5/1980 | Zosel | 208/86 |

*Primary Examiner*—D. E. Gantz
*Assistant Examiner*—Helane Myers
*Attorney, Agent, or Firm*—E. Thomas Wheelock

[57] ABSTRACT

This invention deals with a method for deasphalting heavy oils by mixing the oil with a completely miscible solvent at a low treat ratio and then subjecting the resulting one phase mixture to a gaseous antisolvent, such as carbon dioxide, to separate the mixture into two phases. The upper phase contains the majority of the miscible solvent and the product oil containing a significantly lower CCN then did the feedstock.

7 Claims, No Drawings

METHOD FOR DEASPHALTING HEAVY OILS USING A MISCIBLE SOLVENT AT A LOW TREAT RATIO AND A CARBON DIOXIDE ANTISOLVENT

FIELD OF THE INVENTION

The present invention relates to a process for the recovery of hydrocarbon oils from other heavier oils such as vacuum residual oils, more particularly, to an improved process for selectively deasphalting petroleum oils containing asphalts. The process uses a solvent which is completely miscible with the feedstock heavy oil, and which, when applied at very low ratios of solvent to oil, form a separate phase upon application of carbon dioxide.

BACKGROUND OF THE INVENTION

In a conventional refinery flow scheme, crude oils are subjected to an atmospheric distillation step designed to remove light materials such as gas oils, kerosenes, gasolines, straight run naphtha, etc. The residue from the atmospheric distillation step is then typically subjected to a distillation step at a pressure below atmospheric. The vacuum distillation step produces a vacuum gas oil distillate and vacuum reduced residual oil which often contains asphalts, resins, and heavy hydrocarbonaceous oil components. The additional steps involved in upgrading vacuum resid are important in that these oils are often used as the feedstock for a lubricating oil manufacture.

There are a number of processes used for recovering the useful portions of various asphaltic petroleum residual oils. Many processes involve the extraction of the oil with a deasphalting solvent such as propane, and thereafter separating and recovering the oil components from the solvent. In U.S. Pat. No. 2,950,244, a process for the extraction of petroleum residue containing asphalt is disclosed. The solvent utilized is a liquefied normally gaseous solvent, such as propane, which is maintained at a temperature between 100° and 200° F. and a pressure sufficient to maintain the solvent in a liquid phase.

Variations of the deasphalting process using propane or similar short chain aliphatics as solvents are shown in U.S. Pat. No. 2,669,538 to Yurasko et al; U.S. Pat. No. 3,516,928 to King et al, issued June 23, 1970; U.S. Pat. No. 4,017,383 to Beavon, issued Apr. 12, 1977; and U.S. Pat. No. 4,201,660 to Szosel, issued May 6, 1980. King et al additionally suggests that carbon dioxide and ammonia are, under certain circumstances, equivalent to the disclosed lower alkanes, alkenes and their halogenated derivatives.

Although propane is often used in deasphalting operations, other solvents have been suggested. In U.S. Pat. No. 4,054,512, an asphalt-containing mineral oil is deasphalted by contacting the oil with liquid hydrogen sulfide. The use of liquid neopentane, at a temperature between 0° and 250° F., as the deasphalting solvent is shown in U.S. Pat. No. 3,334,043. In U.S. Pat. No. 2,337,448, heavy residual oil is deasphalted by using a solvent selected from the group ethane, ethylene, propane, propylene, butane, butylene, isobutane, and mixtures thereof.

Multi-stage solvent extraction techniques involving the use of one or more solvents are also known. In U.S. Pat. No. 3,658,665 a heavy oil is subjected to a two-stage extraction process. In the first stage, the heavy oil is contacted with a solvent and the mixture is thereupon subjected to additional solvent in a second zone. The second zone is maintained at a higher temperature than is the first solvent stage. In U.S. Pat. No. 4,017,383, a multi-stage deasphalting process is shown in which the recovery of the solvent from the extracted hydrocarbon is effected in a series of two or more pressure stages. The solvents are liquefied low molecular weight hydrocarbons, such as propane or isobutane.

Additionally there are a number of processes which use multiple or mixed solvents to deasphalt various oils. For instance, in U.S. Pat. No. 2,188,051 to Lantz, issued Jan. 23, 1940, the oil is contacted with solvent preferably containing at least 75% of paraffinic hydrocarbons having less than 7 carbon atoms. Ethane, propane, butane, isobutane, pentanes, and hexanes constitute the preferred solvents. The hydrocarbon solvent is mixed with a carbon dioxide for later addition to the oils to be extracted.

In U.S. Pat. No. 2,631,966 to Francis, issued Mar. 17, 1953, a process using liquid carbon dioxide and a variety of other solvents are used to separate various portions of the hydrocarbon feed. The solvents are divided into two classes. The first class is one whose members are completely miscible with liquid carbon dioxide but incompletely miscible with the oil to be extracted. The second class involves solvents which are incompletely miscible with carbon dioxide and also incompletely miscible with the oil to be extracted. Both sets of solvents are further defined to be those which do not form a solid salt with carbon dioxide at temperatures of 20° C. and higher. Included in the first class of solvents are such compounds as dichlorodiethyl ether, isopropanol, betaethoxy ethanol, diethylene glycol monoethyl ether and the like. Members of the second class of solvents include aniline, o-chloroaniline, m-chloroaniline, cresols and the like. The process generally includes the steps of adding the mixture of carbon dioxide and solvent to the oil and removing the carbon dioxide at various stages to effect separation of various types of hydrocarbon oils. U.S. Pat. No. 2,646,387 also to Francis, issued July 21, 1953, suggests an improvement to the process discussed above. The improvement identifies a method of recovering the solvent from the hydrocarbon oil by addition of liquid carbon dioxide to the solvent-oil mixture so as to form a solvent-carbon dioxide phase.

U.S. Pat. No. 4,179,362 to Irani et al, issued Dec. 18, 1979, suggests the separation of petroleum fractions into aromatic-rich and paraffinic-rich hydrocarbon streams by the use of methanol/water mixtures. The paraffin-rich stream is recovered as raffinate and aromatic-rich stream as the extract. After the extraction step, additional water is added to the extract and raffinate streams where the water acts as an antisolvent to effect separation of the hydrocarbon from the solvent. The water and methanol are then separated either by flash distillation or by using supercritical carbon dioxide as an extraction solvent. In U.S. Pat. No. 4,191,639 to Audeh et al, issued Mar. 4, 1980, hydrocarbon oils such as residual petroleum oils are deasphalted and demetallized by contact with a liquid mixture of at least two of the components selected from hydrogen sulfide, carbon dioxide, and propane.

None of the above references are believed to suggest a process in which a heavy oil is admixed with a solvent which is completely miscible with the oil at low treat ratio followed by treatment of the resulting single phase with carbon dioxide to form separate phases.

SUMMARY OF THE INVENTION

In summary, the present invention relates to a process for deasphalting petroleum residual feedstocks by mixing the feedstock with a low molecular weight solvent preferably selected from the group consisting of toluene and heptane, in an amount and at a temperature at which the solvent and feedstock are completely miscible. The mixture is then treated with gaseous carbon dioxide or other similar antisolvent at a pressure which allows the antisolvent to enter the mixture. Two phases are then formed. The upper phase contains a majority of the miscible solvent and some antisolvent as well as a product oil having a significantly lower microcarbon residue.

The disclosed process may be used as is or sequentially as a pretreatment step for other conventional deasphalting processes.

DESCRIPTION OF THE PREFERRED EMBODIMENTS

As discussed above, the commercial deasphalting of petroleum residual oils typically involves contacting residual oil in a countercurrent extractor with a low molecular weight paraffinic solvent having 3 to 7 carbon atoms. Generally, a treat ratio greater than 4 volumes of solvent to 1 volume of residual oil is needed to obtain good yields of oil because the oil is not highly soluble in the solvent. The oil is more soluble in the heavier solvents, e.g., heptane, but heptane extracts compounds which are precursors to coke in later refinery operations. Furthermore, the heptane is often more soluble in the asphaltene bottoms. This invention helps to alleviate both of these problems.

As noted above, the first step in this process involves intimate mixing of a heavy oil with a solvent. The mixing may take place at any convenient temperature, but the resulting mixture must be raised to a temperature at which the solvent and heavy oil are completely miscible. The residence time of an extraction vessel need not be large so long as the solvent and oil are quite thoroughly mixed. After attainment of the single phase, which for a 1:1 mixture of heavy Arab vacuum residual oil and heptane may take place at room temperature and pressure, the gaseous antisolvent is introduced into the single phase mixture. When gaseous carbon dioxide is used, the resulting mixture should be transported to a settling vessel so that two liquid phases may then form. The injection pressure and the subsequent settling vessel pressure may be as high as 1000 psig.

The resultant upper layer will contain most of the solvent and some carbon dioxide, and an extracted oil having a significantly lower Conradson carbon number (CCN). The upper phase, after removal, may be flashed to remove the majority of the dissolved carbon dioxide. This carbon dioxide is suitable for compression and recycle as the antisolvent. The remaining solvent may be separated by distillation or other suitable means from the extracted oil.

The lower phase, which contains the asphaltenes and other heavy, and usually aromatic, portions of the heavy oil feedstock may also be flashed to remove the carbon dioxide as was done with the upper phase. Because of the differences in boiling points, the heavy oils may be separated from the solvent by a simple still with good efficiency. The remaining oil may be sent to conventional processes for further deasphalting if such is desired.

Alternatively, additional heptane may be added to the flashed, heptane-extracted oil mixture to bring it up to the treat ratio of solvent to heavy oil used in the first step. The mixture may then be treated again with an antisolvent such as carbon dioxide to recover a further fraction of low CCN oil.

The solvents used in the practice of this process should be short chain aliphatic hydrocarbons having from 4 to 12 carbon atoms or toluene. Heptane toluene and octane, preferably heptane, are the preferred solvents since they are readily miscible with the much heavier reduced vacuum oils. Shorter chain solvents are more difficultly soluble and longer chain solvents are difficult to separate using the disclosed antisolvents. The solvent to hydrocarbon treat ratio broadly should be any ratio that allows the solvent to become completely miscible with the hydrocarbon feedstock at a particular temperature. More desirably, the ratio should be between 1:0.75 to 1:1.5. Most preferably the ratio should be about 1:1.

The following are examples of the single stage process practiced according to the invention. They are intended to be only exemplitive and not to be construed as a limiting feature of the invention.

EXAMPLE 1

A 38.5 ml. sample of heavy Arab vacuum residual oil having an initial boiling point of 950+° F. was mixed with 38.5 milliliters of heptane at ambient temperature and pressure. The oil and solvent were completely miscible at these conditions. The mixture was then introduced into a high pressure sight glass reactor and gaseous $CO_2$ was bubbled into the reactor until the pressure reached 54 atmospheres. The phases were then allowed to settle.

The total volume had expanded by 28 milliliters, and a 37 milliliter layer of clear amber liquid appeared over a black heavy layer. The clear liquid was withdrawn and the carbon dioxide was allowed to flash from the mixture. The liquid contained 67% of the initial heptane and 12% of the HAVR from the feedstock. The extracted oil had a 6.9% MCR (microcarbon residue, similar to CCN) as compared with the 21.3% MCR value of the initial feedstock.

EXAMPLE 2

An experiment similar to that found in Example 1 was practiced using toluene as the solvent. The Arab heavy vacuum residual oil was mixed with an equal volume of toluene. The mixture was expanded at 52 atm pressure with carbon dioxide. The system had expanded by 23 ml. (30%). A 20 ml. clear phase was observed. A 12.6 ml. sample of the clear phase was flashed to release the carbon dioxide. The flashed sample weighed 4.17 grams and 11.1% of that weight was oil with 3.93% MCR.

I claim as my invention:

1. A process for extracting hydrocarbon oil from heavy hydrocarbon oil feedstock comprising the steps of:

contacting said heavy hydrocarbon oil feedstock with a solvent at a temperature and in a volume ratio of solvent to feedstock in the range between about 1:0.75 to 1:1.5 such that the solvent and feedstock are completely miscible and form a single phase mixture, introducing a gaseous antisolvent into said single phase mixture to produce an upper phase containing the extracted hydrocarbon oil and a heavier lower phase, and recovering said hydrocarbon oil from the upper phase.

2. The process of claim 1 wherein the heavy oil feedstock is an atmospheric residual oil.

3. The process of claim 1 wherein the heavy oil feedstock is a vacuum reduced residual oil.

4. The process of claim 1 wherein the solvent is a $C_4$ to $C_{12}$ aliphatic hydrocarbon or toluene.

5. The process of claim 4 wherein the solvent is heptane or toluene.

6. The process of claim 5 wherein the antisolvent is carbon dioxide.

7. The process of claim 1 wherein the treat ratio is about 1:1.

* * * * *